US010746003B2

(12) United States Patent
Yang et al.

(10) Patent No.: US 10,746,003 B2
(45) **Date of Patent: *Aug. 18, 2020**

(54) HIGH DENSITY CLUSTER BASED PERFORATING SYSTEM AND METHOD

(71) Applicant: GEODynamics, Inc., Millsap, TX (US)

(72) Inventors: Wenbo Yang, Kennedale, TX (US); James A. Rollins, Lipan, TX (US); Philip Martin Snider, Tomball, TX (US); John Thomas Hardesty, Weatherford, TX (US); David S. Wesson, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/052,101

(22) Filed: Aug. 1, 2018

(65) Prior Publication Data

US 2019/0040722 A1 Feb. 7, 2019

Related U.S. Application Data

(60) Provisional application No. 62/540,369, filed on Aug. 2, 2017.

(51) Int. Cl.

| | |
|---|---|
| ***E21B 43/117*** | (2006.01) |
| ***E21B 43/1185*** | (2006.01) |
| ***E21B 43/11*** | (2006.01) |
| ***E21B 43/119*** | (2006.01) |
| ***E21B 43/116*** | (2006.01) |

(52) U.S. Cl.

CPC ..... *E21B 43/117* (2013.01); *E21B 43/11* (2013.01); *E21B 43/116* (2013.01); *E21B 43/119* (2013.01); *E21B 43/11855* (2013.01)

(58) Field of Classification Search

CPC ..... E21B 43/11; E21B 43/116; E21B 43/117; E21B 43/119

See application file for complete search history.

(56) References Cited

U.S. PATENT DOCUMENTS 4,140,188 A 2/1979 Vann
4,534,423 A * 8/1985 Regalbuto ..... F42B 3/08 166/297

(Continued)

OTHER PUBLICATIONS

International Search Report and Written Opinion of the International Searching Authority (Forms PCT/ISA/220, PCT/ISA/210 and PCT/ISA/237), dated Oct. 30, 2018, for related International Application No. PCT/US18/044967.

(Continued)

*Primary Examiner* — Tara E Schimpf

(74) *Attorney, Agent, or Firm* — Patent Portfolio Builders PLLC

(57) ABSTRACT

A perforating short gun for use in a horizontal well casing. The gun includes a gun carrier and a charge holder to carry shaped charges. The charge holder is inserted into the gun carrier and a selected length of the gun carrier includes internal features created therein to a depth in an inside wall of the gun carrier. The internal features are located and configured to align with a shaped charge, creating a standoff between the shaped charge and the internal feature such that when the charge is detonated it creates an opening through the internal feature.

23 Claims, 7 Drawing Sheets

(56) References Cited

U.S. PATENT DOCUMENTS

| | | | | |
|---|---|---|---|---|
| 4,726,431 | A * | 2/1988 | Oestreich | E21B 43/117 102/310 |
| 4,800,815 | A * | 1/1989 | Appledorn | E21B 43/117 102/312 |
| 5,054,564 | A * | 10/1991 | Oestreich | E21B 43/117 102/320 |
| 9,145,763 | B1 * | 9/2015 | Sites, Jr. | E21B 43/119 |
| 2004/0107825 | A1 | 6/2004 | Kash | |
| 2005/0167108 | A1 | 8/2005 | Chang et al. | |
| 2006/0118303 | A1 | 6/2006 | Schultz et al. | |
| 2007/0079966 | A1 * | 4/2007 | George | E21B 43/117 166/297 |
| 2014/0053715 | A1 * | 2/2014 | Zhang | E21B 43/116 89/1.15 |
| 2014/0331852 | A1 | 11/2014 | Martinez | |
| 2016/0349021 | A1 * | 12/2016 | Collier | F24B 1/028 |
| 2017/0107799 | A1 | 4/2017 | Rodgers et al. | |
| 2018/0274342 | A1 * | 9/2018 | Sites | F42B 3/22 |

OTHER PUBLICATIONS

U.S. Office Action for related U.S. Appl. No. 16/285,392 dated Jun. 3, 2019. (With the exception of the references cited herein, the remaining references cited in the U.S. Office Action are already of record).

U.S. Office Action for related U.S. Appl. No. 16/285,392 dated Nov. 25 2019. ((All references not cited herewith have been previously made of record.).

* cited by examiner

HIGH DENSITY CLUSTER BASED PERFORATING SYSTEM AND METHOD

CROSS REFERENCE TO RELATED APPLICATIONS

This application claims priority from U.S. application Ser. No. 62/540,369 filed Aug. 2, 2017, the disclosure of which is fully incorporated herein by reference.

BACKGROUND

1. Field of the Invention

The present technology relates generally to perforation guns that are used in the oil and gas industry to explosively perforate well casings and underground hydrocarbon bearing formations, and more particularly to an improved apparatus for high density cluster based perforating with shorter guns machined with internal features.

2. Description of the Related Art

During a well completion process, a gun string assembly is positioned in an isolated zone in the wellbore casing. The gun string assembly comprises a plurality of perforating guns coupled to each other, either through tandems or subs. The perforating gun is then fired, creating holes through the casing and the cement and into the targeted rock formation. These perforating holes allow fluid communication between the formation containing the oil and gas, and the wellbore. The firing of the perforating gun detonates charges that are loaded in the perforation gun. Typically, these are shaped charges that produce an explosive-formed penetrating jet in the chosen direction in which the charge is directed.

The perforating gun includes a conveyance for the shaped charges such as a hollow carrier, often in the shape of a tube, charge holder end plates, shaped charges, a detonating cord, and the detonator. In general, shaped energetic charges perforate through scallops on the outside of a perforating gun. A hollow carrier perforating gun has relief ports drilled part way through the gun body to provide an exit point for the perforation charge and to provide a recess to minimize damage from the burr that forms around the exit hole in the perforating gun.

Typical high shot density perforating guns employ an array of shaped charges spaced at intervals along the length of the perforating gun. Each array typically utilizes three or four shaped charges with each array spaced three to four inches apart. While high shot density perforating guns of these designs have proven successful in larger diameter guns, they are unsuited for smaller diameter guns that have shorter lengths. Small diameter, i.e. four inches or less outer diameter, perforating guns are not suited for using an array of shaped charges. To employ such an array requires a significant reduction in the size and caliber of the shaped charges, thereby significantly reducing the amount of explosives. This would be expected to have a deleterious effect on the depth of perforation, and subsequently on production. An additional difficulty in achieving high shot density, with a small diameter perforating gun is that of charge interference. Charge interference is the disturbance of the order of the undetonated charges in the gun by the explosion of a detonated charge. To avoid charge interference, the detonator cord must set off a charge before the explosion of a previous charge interferes with the subsequent charge.

BRIEF SUMMARY

Exemplary embodiments provide a perforating gun for use in a horizontal well casing. The gun includes a gun carrier and a charge holder configured to carry shaped charges. The loaded charge holder is inserted into the gun carrier and an internal feature, such as a scallop, in an inside wall of the gun carrier aligns with each of the shaped charges of the holder. The internal feature creates a "standoff" (i.e. a distance) between the shaped charge that registers with it, such that when detonated, the shaped charge creates an opening through the internal feature.

In an exemplary embodiment there is provided a perforating gun for use in a well casing where the gun carrier has an inner wall with internal features therein extending into the inner wall to a depth. A charge holder configured to carry charges is inserted into the gun carrier. When the charge holder, loaded with charges, is inserted into the gun carrier, each charge is adjacent to an internal feature of the inner wall. This creates a standoff between the charge and the internal feature such that when detonated, each charge creates an opening through the internal feature.

The gun carrier may range in length from 6 inches to 11 inches, or less than 14 inches. The diameter of the gun carrier may range from 1 to 4 inches, or from 4 to 8 inches.

A detonator cord may extend along a length of the charge holder and pass through each of the shaped charges.

The standoff between charge and internal feature may range from 0.15 to 2.5 inches.

The internal feature may be an elongate shaped scallop extending circumferentially (at least partially) around the inner wall surface of the gun carrier. The scallop may have a constant thickness portion and a peripheral variable thickness portion in the inner wall surrounding the constant thickness portion.

An internal feature may be added, in the form of a hyper dome, for example, extending circumferentially outwards from an external scallop on the outside wall of the gun carrier.

The wall thickness of the gun carrier may range from 0.20 to 0.75 inches. However, to achieve tight clustering greater standoff is necessary and wall thickness is reduced by internally machining features, such as grooving or scalloping, to the range as low as $^{50}/_{1000}$ths to $^{75}/_{1000}$ths of an inch. In short, the extent of further compressing the charges together necessitates an increase in the degree of wall thinning.

The shaped charges may be oriented in an upward direction or a downward direction in the wellbore.

The charges may be arranged such that groups of charges lie in a plane transverse to the longitudinal axis of the perforating gun. The number of charges positioned in a single plane transverse to a longitudinal axis of the perforating gun may be 2, 3, or 4. When the total number of charges is a multiple of 3, each successive vertically spaced apart plane of the perforating gun, transverse to a longitudinal axis, has 3 charges. When the number of shaped charges is a multiple of 4, each successive vertically spaced apart plane transverse to a longitudinal axis of the perforating gun has 4 charges.

The total number of charges may range from 2 to 16.

The charges may be reactive liner shaped charges.

Optionally, there may be external features formed on an outside of the wall, configured and located to register with the internal features.

In another exemplary embodiment there is provided a universal cluster gun used for perforation in a well casing.

The gun has gun carrier and a charge holder configured charge holder configured to be inserted into the gun carrier and to hold shaped charges in charge cases. The charge cases are arranged in two planes or three planes; each of the planes are transverse to the longitudinal axis of the gun. The charge cases include from 2 to 8 shaped charges.

The inner wall of the gun casing may have internal features extending to a depth therein, such that when a charge holder loaded with charges is inserted into the gun carrier, each charge is adjacent to an internal feature of the inner wall, and a standoff is created between the charge and the internal feature.

The length of the gun carrier may range from 4 inches to 11 inches.

The length of the gun carrier may be less than 16 inches.

Optionally, at least 3 shaped charges occupy the charge cases in one of the two planes plane, and at least 3 shaped charges occupy the charge cases in the other of the two planes.

Optionally, at least 2 shaped charges occupy the charge cases in one of the two planes, and at least 3 shaped charges occupy the charge cases in the other of the two planes.

Optionally, at least 2 shaped charges occupy the charge cases in one of the two planes and at least 4 shaped charges occupy the charge cases in the other of the two planes.

Optionally, an end cap may be mounted to cover one or both ends of the charge holder(s).

BRIEF DESCRIPTION OF THE DRAWINGS

For ease of understanding of exemplary embodiments, described herein below in more detail, reference may be made to the accompanying schematic, not-to-scale, non-limiting drawings of exemplary embodiments, wherein.

DETAILED DESCRIPTION

Figure 1A:
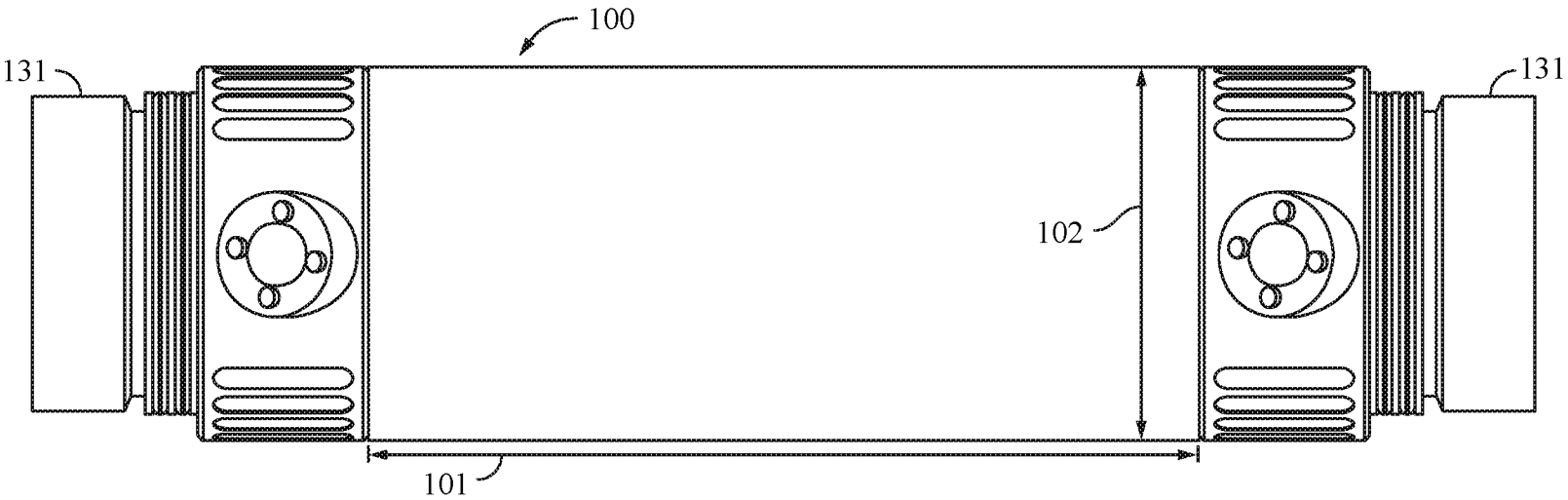
FIG. 1A and FIG. 1B are side and cross sectional views of a perforating gun suitable for use with exemplary embodiments.

Briefly, by way of introduction, the present technology addresses limitations in prior art "planar perforating gun" systems (with charges arranged in the same lateral plane). Often prior art (planar) gun systems are not available for pump down plug and perf applications in horizontal or deviated wellbores while providing sufficient standoff. In high density perforations with a small gun, when there are multiple charges arranged in a plane transverse to the longitudinal axis of a gun carrier, either the standoff is too short or the caliber of the shaped charges is too small for effective perforations, or both.

As an example, in U.S. Pat. No. 4,140,188A there is a perforating gun for perforating a casing with a high density distribution of shots arranged in a specific symmetrical pattern. The apparatus includes a gun housing within which a plurality of shaped charges are formed into a cluster, and a plurality of clusters are incorporated into each of the housings with the clusters being spaced apart from one another both vertically and radially to achieve a high density symmetrical perforating pattern comprised of 12-20 shots per foot. However, U.S. Pat. No. 4,140,188A does not disclose a perforating gun with an internal feature to increase standoff so that the charges, when detonated, produce an explosive penetrating jet that clears the gun carrier without interference to perforate the formation. In a typical jet created by shaped charges, the velocity of the tip end may be slightly greater than a velocity of the tail end so that the extended portion is substantially not stretched and therefore maintains a constant diameter after entry into a hydrocarbon formation until the tip end enters the formation. Typically, the formation of the jet occurs in the charge case and near the inside wall of the gun carrier behind the scallop/spotface. The diameter of the jet in the initial (jet formation) region or tip end may be larger than the diameter after it has been fully developed. Different parts of the jets have different diameters. The hole in the gun carrier may be formed during the jet formation process and is comparatively larger than the hole formed in the casing by the fully developed jet. Increased standoff is required for charges so that a jet created by the charges has enough space to travel and a constant portion of the jet penetrates through the carrier. Prior art apparatus do not provide for an increased standoff (distance between the face of a charge and the inside surface of a gun carrier) with a recessed internal feature in an inside surface of the carrier so that a jet created by the shaped charge is effective. Accordingly, the present technology provides in one aspect gun systems using multiple charges per plane for use in fracture application with ultra-short gun assemblies that enable high density perforation.

In addition, most perforating guns are preloaded with shaped charges before shipping to the field of operations. Depending on the design of a stage and cluster size, the perforating guns may be loaded with 2-8 charges. Therefore, an inventory of 2-charge guns, 3-charge guns and so on, are maintained to accommodate needs that may arise for a particular number of charges. However, it may not be necessary to perforate with all the charges, depending on the field conditions.

The present technology provides perforating guns that are shorter in terms of length per number of charges. This provides the potential for utilizing shorter perforating guns, so that there is little unused or "wasted" gun length. The perforating guns may be loaded with from 2 to 6 shots and that are flexible and adaptable to changing field conditions. The present technology also provides universal perforating guns loaded with from 1 to 8 shots such that at least 2 shaped charges, arranged in 2 planes, and at least one shaped charge occupies one of the slots in the perforating gun.

Exemplary embodiments of the present technology provide a perforating gun for use in a horizontal well casing. The gun includes a gun carrier and a charge holder configured to carry shaped charges. The loaded charge holder is inserted into the gun carrier and an internal feature, such as a scallop, in an inside wall of the gun carrier aligns with each of the shaped charges of the holder. The internal feature creates a "standoff" (i.e. a distance) between the shaped charge that registers with it, such that when detonated, the shaped charge creates an opening through the internal feature.

In another exemplary embodiment there is provided a universal cluster gun used for perforation in a well casing. The gun has gun carrier and a charge holder configured charge holder configured to be inserted into the gun carrier and to hold shaped charges in charge cases. The charge cases are arranged in two planes or three planes; each of the planes are transverse to the longitudinal axis of the gun.

In general, during use, after a stage has been isolated for perforation, a perforating gun string assembly (GSA) may be deployed and positioned in the isolated stage. The GSA may include a string of exemplary perforating guns such as gun mechanically coupled to each other through tandems or subs or transfers. The GSA may orient itself such that a plurality of charges inside a charge holder (CHT) are angularly oriented or not. The plurality of shaped charges in the gun together may herein be referred to as "cluster". The perforating guns may be centered or off-centered in the casing. The well casing may be horizontal or deviated.

Exemplary embodiments may be more fully appreciated with reference to the accompanying drawings, which are discussed here below.

FIGS. 1A and B illustrate views of an exemplary perforating gun system (0100) according to an exemplary embodiment. According to an exemplary embodiment, a perforating gun (0122) for use in a horizontal well casing, includes a gun carrier (0129) (tubular in this example) and a charge holder (0130) that carries shaped charges (0123, 0124, 0125, and 0126). The charge holder is inserted into the gun carrier (0129) and positioned in place with end plates (0133) on either end. A selected length (0101) of the gun carrier enables an internal feature (0127) to be machined on an inside wall (0131) of the gun carrier. The internal feature (0127), when aligned with each of the charges, which may be shaped charges, allows for a standoff (0132) between a face of the charges (1033) and the internal feature such that the shaped charges create openings substantially through the internal feature.

Figure 1B:
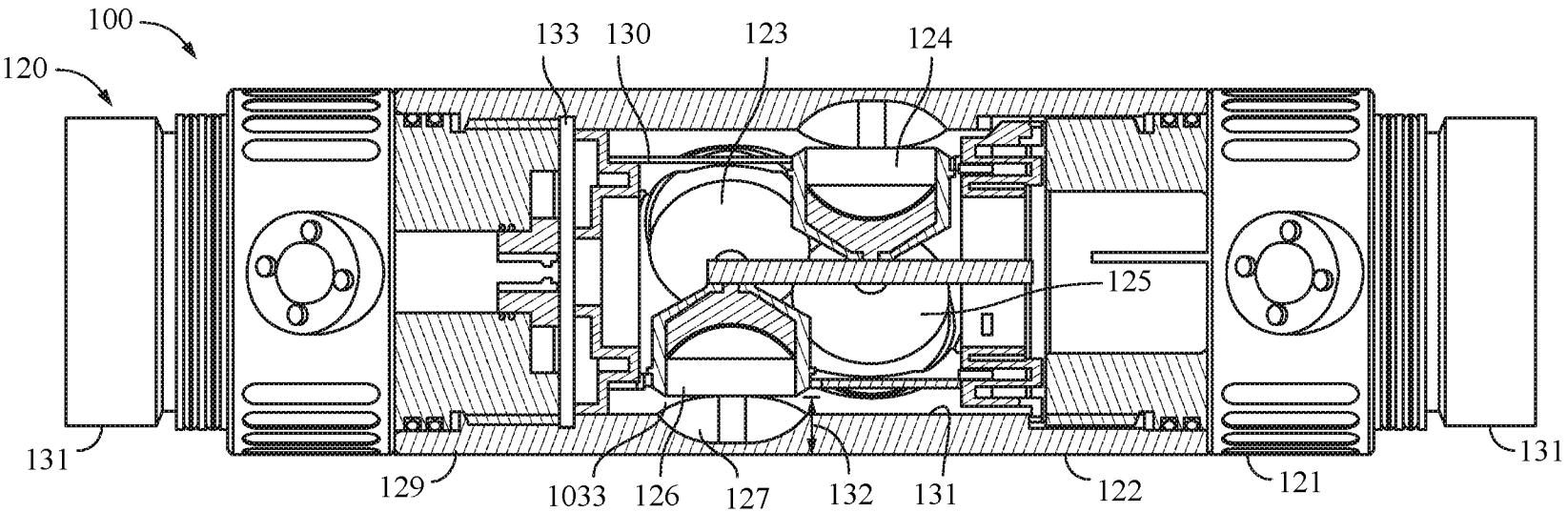

The perforating gun (0120) may be coupled to a sub (0121) at one end and another sub (0131) on the opposite end. The charge holder (130) and the gun carrier may be connected to an end plate (0133) on both ends. According to an exemplary embodiment, the length of the gun carrier (101) ranges from 4 inches to 11 inches. According to a another exemplary embodiment the length (0101) of the gun carrier is less than 16 inches. According to a yet another exemplary embodiment the length of the gun carrier is less than 18 inches. According to an exemplary embodiment the diameter (0102) of the gun carrier ranges from about 1 to about 6 inches. According to a more exemplary embodiment the diameter of the gun carrier ranges from 3 to 6 inches. The perforating gun assembly includes a carrier gun body and a charge holder disposed within the carrier gun body. According to an exemplary embodiment the diameter of the gun carrier ranges from 4 to 8 inches. Located at the nose of a charge case is a plurality of ears which extend outwardly from the charge case in a parallel fashion to receive a detonator cord (0128). According to an exemplary embodiment the detonator cord (0128) passes through each of the shaped charges 1033; the detonating cord 0128 passing longitudinally substantially along a center of the charge holder. The length from the base of the charge liner to the ears is such that the longitudinal axis of the detonating cord is located slightly off center, of the charge holder, thereby allowing a snug fit of the detonator cord within the ears when the primer cord is put in tension upon assembly. The detonator cord is conductively attached to an electrical means to sequentially fire the banks of shaped charges arrayed along its length. According to an exemplary embodiment the shaped charges create a jet such that the jet substantially clears the standoff in the well casing and create openings in a well casing. According to an exemplary embodiment a diameter of the openings ranges from 0.2 inches to 1.2 inches. According to a more exemplary embodiment a diameter of the openings ranges from 0.3 inches to 0.6 inches. The exemplary gun system enables an increased standoff (0132) (distance between the face of a charge (0133) and the inside surface (0131) of a gun carrier) with a recessed internal feature (0127) on an inside surface of the carrier (0131) so that a jet created by the shaped charges is effective in penetrating through the internal feature (0127). According to an exemplary embodiment the standoff ranges from 0.10 inches to 0.75 inches. According to a more exemplary embodiment the standoff ranges from 0.30 inches to 0.6 inches. The exemplary apparatus as illustrated in FIG. 1A and FIG. 1B, provides for perforating guns for high density perforations with charges arranged in a plane transverse to the longitudinal axis of a gun carrier with increased standoff and without decreasing caliber of shaped charges for effective perforations. Increased standoff enables a jet created by the charges to have enough space to travel and a constant portion of the jet penetrates through the carrier. Additionally, the exemplary apparatus of FIG. 1A and FIG. 1B provides for perforating guns with length less than 14 inches and a shot density greater than 8 shots. Furthermore, the exemplary apparatus of FIG. 1A and FIG. 1B provides for perforating guns with an aspect ratio (ratio of length of the carrier and the diameter of the gun carrier) in the range of 1.0 to 3.5 and also provide a high shot density.

Figure 2A:
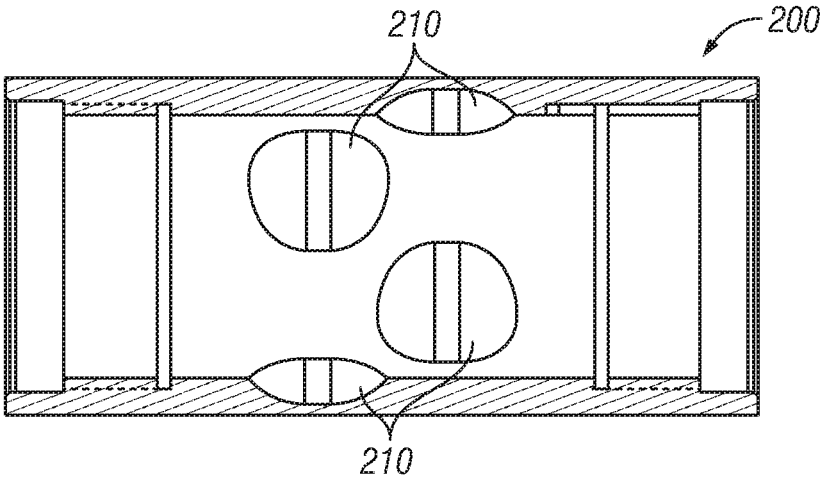
FIG. 2A is a side view in cross section of an exemplary embodiment of a perforating gun.
Figure 2B:
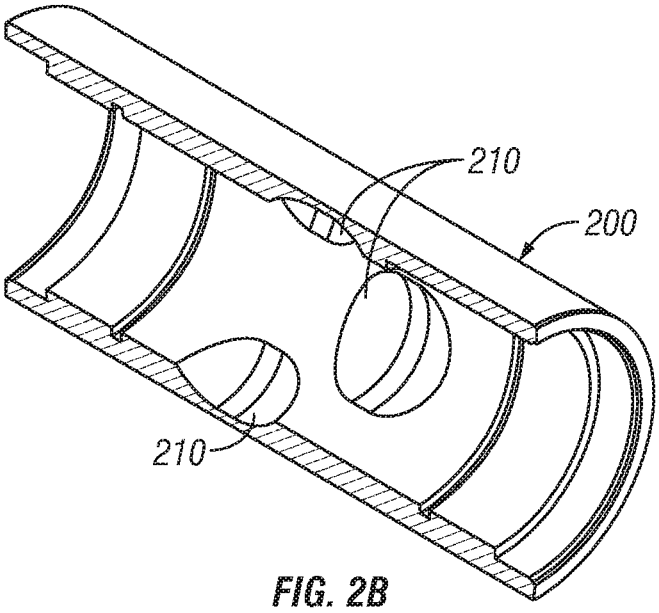
FIG. 2B is another view of the exemplary perforating gun of FIG. 2A.
Figure 2C:
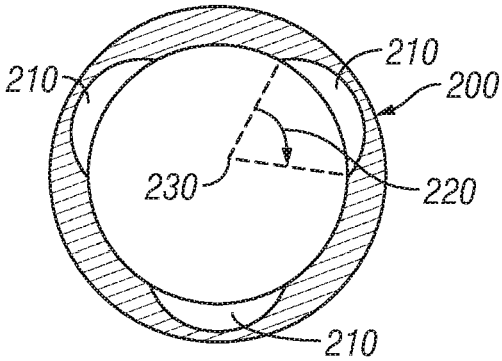
FIG. 2C is an end sectional view of the exemplary embodiment of FIG. 2A.

FIGS. 2A, 2B and 2C are views of an exemplary perforating gun (200) illustrating an internal feature suitable for use in exemplary embodiments. According to an exemplary embodiment internal features (210) are elongated shaped scallops. As illustrated in FIG. 2B the elongated shaped scallop (210) extend circumferentially within an inside wall of the gun carrier such that the scallop has a constant thickness portion nearer a center thereof and a variable thickness portion nearer a perimeter thereof in the inside wall. The variable thickness portion may be configured on either end of the central constant thickness portion. An end of the variable thickness portion is configured with a thickness substantially equal to a thickness of the wall. An arcuate length of the constant thickness portion subtends an angle (220) at a center (230) of the perforating gun. According to an exemplary embodiment, a thickness of the gun carrier ranges from 0.20 to 0.75 inches. As generally illustrated in FIG. 2C, internal features (210) may be machined in the inner wall of the gun carrier (200). In one method the internal features may be machined by holding the hollow gun carrier in place, inserting a shaft with a radial cutter longitudinally into the hollow gun carrier, reaching a desired location of the internal feature, rotating the radial cutter circularly, removing material from the inside wall of the gun carrier, creating the internal feature; and removing the shaft and the radial cutter. The internal features may be aligned to a corresponding shaped charge disposed in a charge holder.

According to an exemplary embodiment the internal feature is a "hyper dome" that extends circumferentially outwards from an external scallop created on the outside wall of the gun carrier. In general, a hyperdome is a structure created by machining the outside surface, as in the case of scalloped gun carrier, and then placing a tool inside the gun carrier to urge outward on the inner surface thereby creating an internal dome shape. Herein, such domes are referred to as "hyperdomes." The shape of the hyperdome provides a charge loaded to the carrier with an additional standoff. Of course, these are not the only structures that can be used to increase the standoff. According to another non-limiting exemplary embodiment, the internal feature is a groove, such as a right angled shaped groove.

Figure 3A:
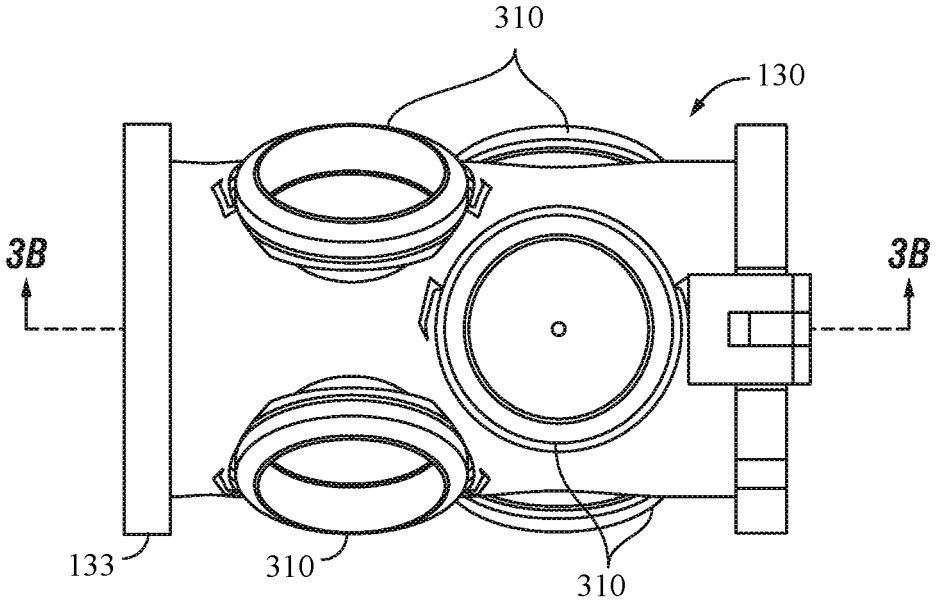
FIGS. 3A and 3B are views of an exemplary embodiment of a perforating gun for 6 shaped charges, in side and cross sectional view, respectively.
Figure 3B:
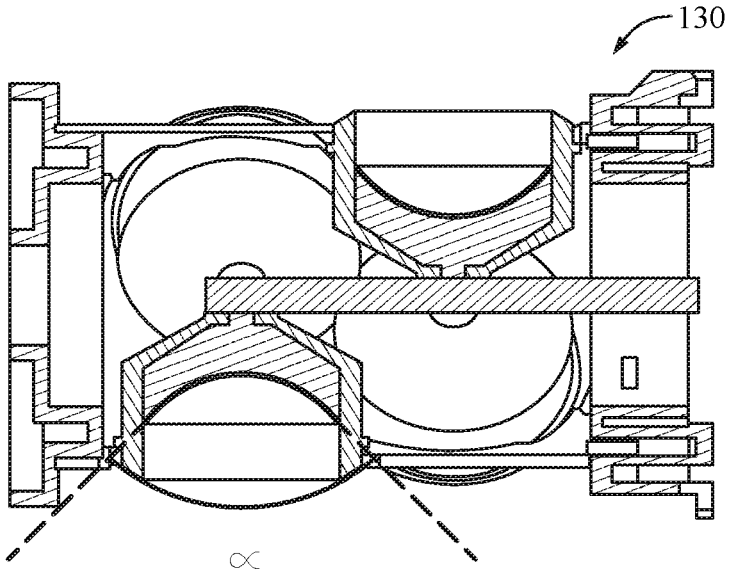
Figure 4A:
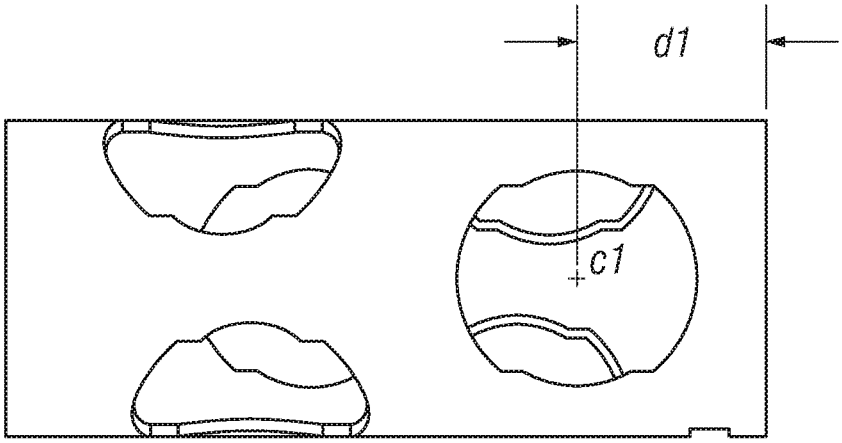
FIGS. 4A, 4B, 4C, 4D, 4E and 4F are illustrative side views with each consecutive numbered figure rotated by 60 degrees from one view to the next depicting an example of a double spiral arrangement of openings on an external surface on an exemplary embodiment of a perforating gun.
Figure 4B:
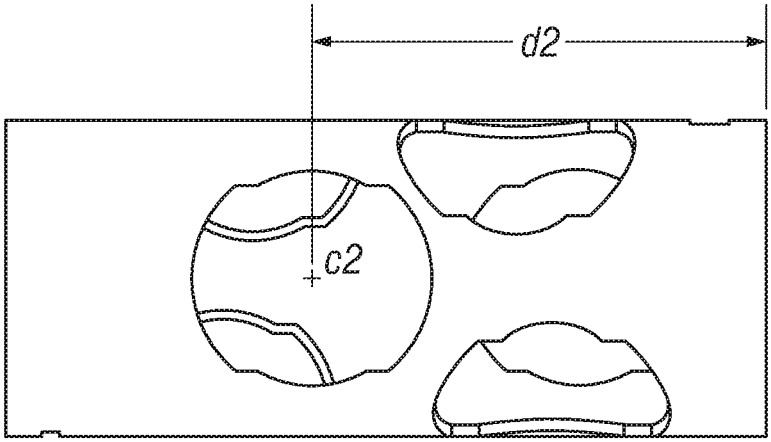
Figure 4C:
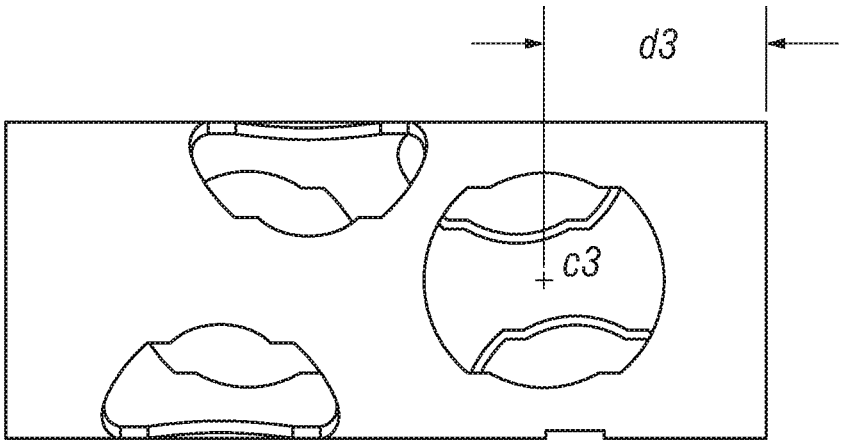
Figure 4D:
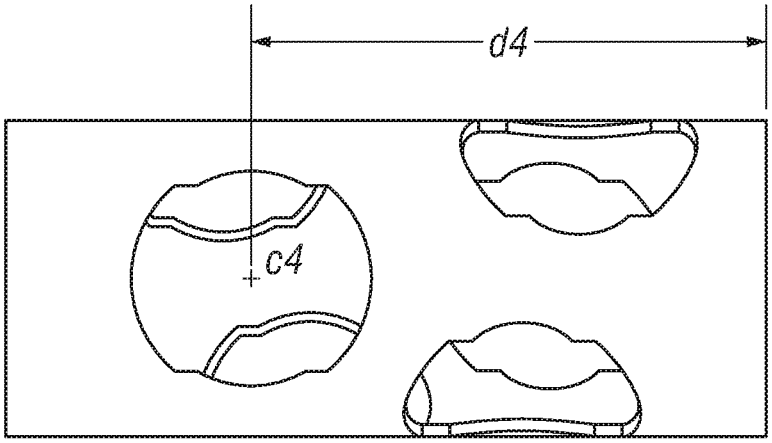
Figure 4E:
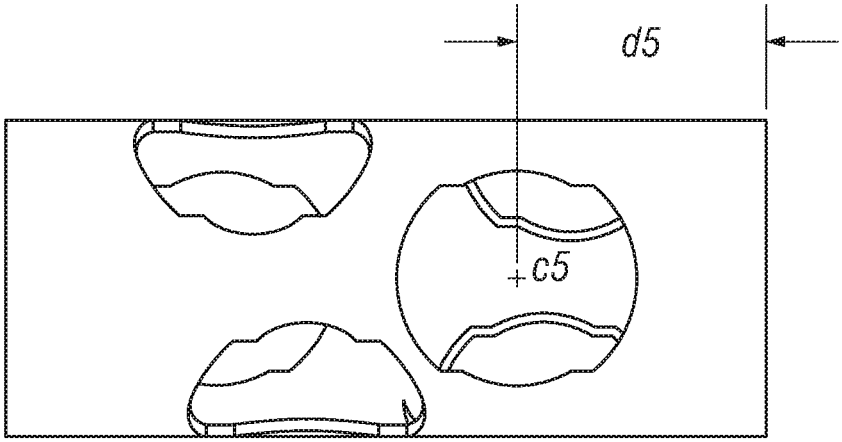
Figure 4F:
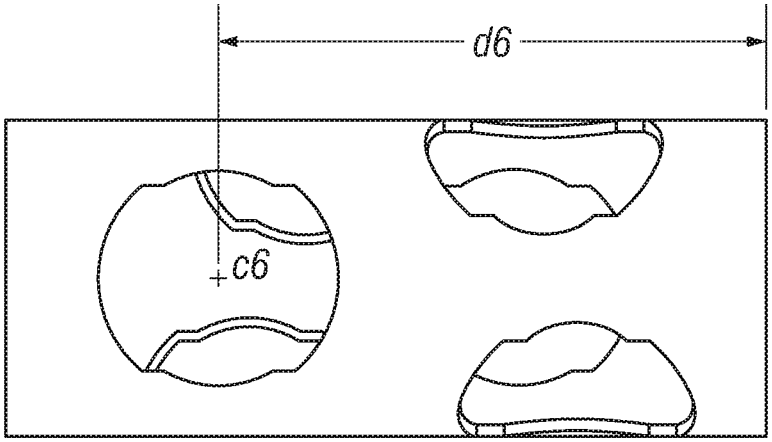

FIGS. 3A and 3B are views of an exemplary perforating gun with 6 shaped charges (locations indicated by 310). According to an exemplary embodiment, the number of shaped charges ranges from 2 to 16. According to another exemplary embodiment, the number of shaped charges is 6. In this case, 3 of the charges are positioned in a first plane transverse to the longitudinal axis of the perforating gun and the remaining 3 of the charges are positioned in a second plane transverse to the longitudinal axis of the perforating gun. According to another exemplary embodiment, the number of shaped charges is 3; the charges positioned in a single plane transverse to the longitudinal axis of the perforating gun. According to yet another exemplary embodiment, the number of shaped charges is 4; the charges positioned in a single plane transverse to the longitudinal axis of the perforating gun. The charges may be circumferentially positioned in the charge holder such that the angle between two adjacent charges is 90 degrees. In other words, the charges may be positioned at 0, 90, 180 and 270 degrees in a circular manner. According to another exemplary embodiment, the number of shaped charges is 8; with 4 of the charges positioned in a first plane transverse to the longitudinal axis of the perforating gun and the remaining 4 of the charges positioned in a second plane transverse to the longitudinal axis of the perforating gun. The charges may be positioned in the charge holder in each plane such that the angle between two adjacent charges is 90 degrees. According to an exemplary embodiment the shaped charges are arranged such that each of the shaped charges occupy a distinct plane; the distinct plane transverse to the longitudinal axis of the perforating gun. For example, in a 2 charge system one charge may occupy one plane and another charge occupies another plane that is parallel to the first plane. For example, in a 3 charge system one charge may occupy a first plane, a second charge occupies a second plane and a third charge occupies a third plane and the first, second and third planes parallel to each other. In a four charge system, two charges may occupy a first transverse plane and the remaining two charges may occupy a second transverse plane. Alternatively, it is also possible to arrange the four charges such that one charge occupies one transverse plane and the remaining three charges occupy a second transverse plane that is parallel to the first place. According to an exemplary embodiment, the charges are selected from a group consisting of reactive and non-reactive charges. According to another exemplary embodiment the charges are selected from a group consisting of deep penetrating charges, big hole charges, and equal entry hole charges. It should be noted that even though internal features are not shown in FIGS. 3A and 3B, the internal features may be machined on the inside wall of the gun carrier, as depicted for example in FIG. 2.

In an exemplary embodiment the charges are arranged in spiral arrays along the length of the gun, such that the number of charges per gun length is increased, and as a result the gun length per charge is decreased. Thus, comparing the loci of centers of openings (charge locations), the loci form a spiral for one set of centers, and an opposing spiral for the other set of centers. This is exemplified in FIGS. 4A-E depicting external views of a gun 400 having two opposing spiral arrays of charge openings as it is rotated through 60 degrees from 4A to 4B, and then another 60 degrees from 4B to 4C, then another 60 degrees from 4C to 4D, then another 60 degrees from 4D to 4E and finally through 60 degrees to 4F. In the example illustrated, there is an offset distance (d1, d2, d3, d4, d5, d6) from the center point (c1, c2, c3, c4, c5, c6) of each opening that is nearest an end of the gun, from the end of the gun carrier. In the case of the first spiral, FIGS. 4A, C and E, the relative distances are d1<d3<d5. In the case of the second spiral, FIGS. 4B, D and F, the relative distances are d2<d4<d6. In the illustrated non-limiting embodiment there are six charges, in two opposing spirals of 3 each, all at 120 degrees. The reversing spiral effectively "clocks" one set vs the other at approximately 60 degrees. This arrangement provides an improvement (increase) in standoff relative to non-spiral arrangements. Thus, for example only, and without limitation, in a two spiral embodiment having 3 holes per spiral, d1 might be 1,275, d2 3.073, d3 1.475, d4 3,473, d5 1.675, and d6 3.673 inches.

Figure 5A:
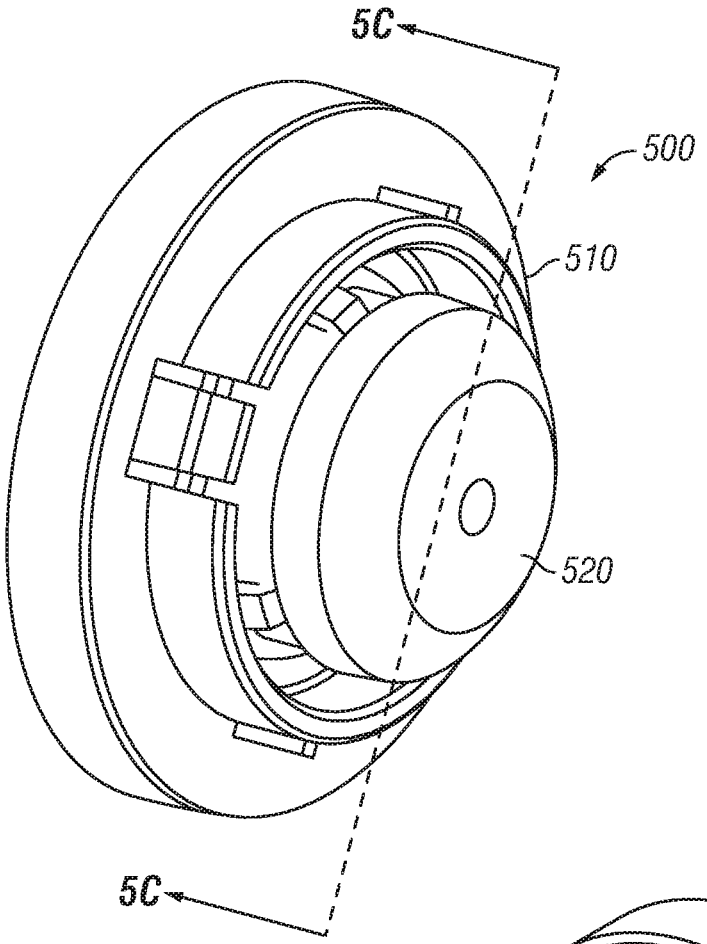
FIG. 5A is an illustrative exterior perspective view of an exemplary embodiment of an end cap configured for use with embodiments of exemplary embodiments of a perforating gun.
Figure 5B:
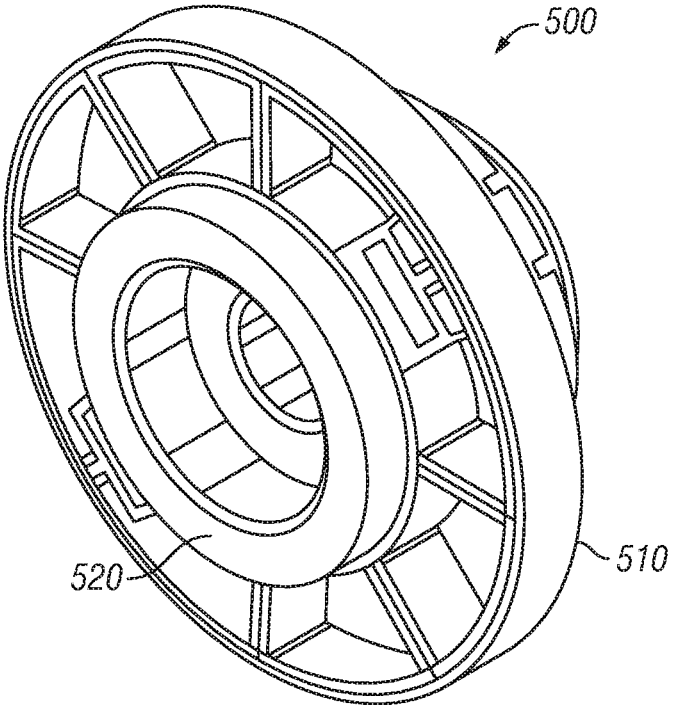
FIG. 5B is an illustrative interior perspective view of the exemplary embodiment of the end cap of FIG. 5A.
Figure 5C:
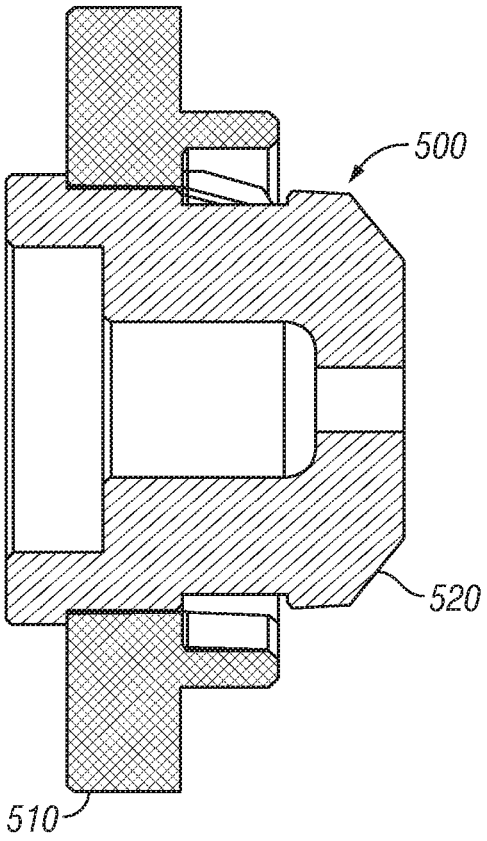
FIG. 5C is an illustrative cross sectional view of the exemplary embodiment of the end cap of FIG. 5A.

FIGS. 5A, B and C depict endcaps 500 that may be mounted to one or both of the ends of charge holders of the perforating guns. As shown, especially in FIG. 5C, in the exemplary embodiment the endcaps may include an end plate 510, around an end cap insert 520. The endplate 510 may be fabricated of a light weight material, such as but not limited to plastic or metal. The end cap insert may be fabricated of a stronger material, if desired, such as but not limited to, steel. In the example shown, the end cap insert 520 clips into the end plate 510, but other attachment configurations are also possible, such as a screw fit. Further, the end cap 500 may be a single piece device made of steel or an extruded plastic, or another suitable material. The end cap 500 may be friction fitted to an end of a charge holder, or may be screw fitted, as desired. The manner of mounting to the charge holder gun is a matter of choice, convenience and suitability under the conditions of use expected.

Often, perforating guns are preloaded with shaped charges before shipping to the field of operations. Depending on the design of a stage and cluster size, the perforating guns may be loaded with 2-8 charges. However, it may not be necessary to perforate with all the charges depending on the field conditions. According to an exemplary embodiment, a universal perforating cluster gun loaded with 2 to 6 shots is flexible and adaptable to changing field conditions. The universal perforating gun may be loaded with 1 to 8 shots such that at least 2 shaped charges arranged in 2 planes and at least one shaped charge occupies one of the slots in the perforating gun.

According to another embodiment, a universal cluster gun used for perforation in a well casing has a gun carrier and a charge holder configured to hold shaped charges in charge cases; the charge holder configured to be inserted into the gun carrier; the charge cases arranged in at least two planes and at most three planes; each of the planes transverse to the longitudinal axis of the gun; wherein the charge cases are occupied by at least 2 shaped charges and at most 8 shaped charges.

According to an exemplary embodiment, the universal cluster gun may be configured with at least 3 shaped charges that occupy the charge cases in one of the two planes plane and at least 3 shaped charges occupy the charge cases in the other of the two planes. According to another exemplary embodiment, the universal cluster gun is configured with at least 2 shaped charges that occupy the charge cases in one of the two planes and at least 3 shaped charges that occupy the charge cases in the other of the two planes. According to yet another exemplary embodiment, the universal cluster gun is configured with least 2 shaped charges that occupy the charge cases in one of the two planes and at least 4 shaped charges that occupy the charge cases in the other of the two planes. The unoccupied charge cases may filled with spacer objects. The material of the spacer objects may include radioactive tracer, propellant, metal, degradable, reactive, plastic, injection molded plastic, reactive metal, and the like, as necessary or desirable.

Exemplary embodiments may also have external features machined or otherwise created on the outside of the wall such that external features each align to register with an internal feature.

An exemplary embodiment includes a gun carrier and a charge holder to carry shaped charges. The charge holder is inserted into the gun carrier and a selected length of the gun carrier includes a plurality of internal features, such as scallops, machined or otherwise created on an inside wall of the gun carrier. The internal features each align with one of the shaped charges thereby creating a standoff between the shaped charge and the internal feature such that when the shaped charge is detonated it creates an opening through the internal feature. A ratio of the length of the gun to the diameter of the gun ranges from about 1 to about 3.5.

In another embodiment, the gun has a gun carrier and a charge holder configured to hold shaped charges. The charge holder is configured to be inserted into the gun carrier. A length of the gun carrier has an internal feature machined on an inside wall of the gun carrier, and located to register with a charge. Each of the charges includes a case with a liner positioned within the case, and an explosive filled within the liner. The liner shape has a subtended angle $\alpha$ of from about 100° to about 120° about an apex of the liner such that a jet formed with the explosive creates an entrance hole in the well casing. The jet creates a perforation tunnel in a hydrocarbon formation.

Yet another embodiment has a gun carrier and a charge holder configured to hold shaped charges in charge cases. The charge holder is configured to be inserted into the gun carrier. The charge cases are arranged in at least two planes, and at most three planes. Each of the planes is transverse to the longitudinal axis of the gun. The charge cases are occupied by at least 2 shaped charges, and at most 8 shaped charges An exemplary method of machining an internal feature in a perforating gun includes at least some of the following steps:

(1) holding the hollow gun carrier in place;
(2) inserting a shaft with a radial cutter at its end longitudinally into the hollow gun carrier;
(3) reaching a desired location of the internal feature;
(4) rotating the radial cutter;
(5) removing material from the inside wall of the gun carrier with the cutter;
(6) creating the internal feature; and
(7) removing the shaft with its radial cutter.

Of course, this is an example of a method of making internal features, such as scallops in a gun carrier, and other methods may also be used to create internal features.

Exemplary embodiments of the present technology have one or more of the following characteristics:

The shaped charges create a jet such that the jet substantially clears the standoff in the well casing.

The length of the gun carrier ranges from 4 inches to 11 inches.

The length of the gun carrier is less than 16 inches,

A detonator cord configured to pass through each of the shaped charges; the detonating cord passing longitudinally substantially along a center of the charge holder.

The standoff ranges from 0.10 inches to 0.75 inches.

The diameter of the gun carrier ranges from 1 to 6 inches.

The internal feature is an elongated shaped scallop; the elongated shaped scallop extending circumferentially within an inside wall of the gun carrier such that the scallop has a constant thickness portion and a variable thickness portion in the inside wall; the variable thickness portion configured on either end of the constant thickness portion; an end of the variable thickness portion configured with a thickness substantially equal to a thickness of the wall; an arcuate length of the constant thickness portion subtending an angle at a center of the perforating gun.

A hyper dome; the hyper dome extending circumferentially outwards from an external scallop; the external scallop created on the outside wall of the gun carrier.

The internal feature is a groove, for example, a right angled shaped groove.

The thickness of the gun carrier ranges from 0.20 to 0.75 inches.

The diameter of the gun carrier ranges from 4 to 8 inches.

A ratio of the length to a diameter of the gun carrier ranges from 1 to 3.5.

A ratio of the length to a diameter of the gun carrier ranges from 1 to 2.

The number of shaped charges ranges from 2 to 12; the charges positioned in a single plane transverse to the longitudinal axis of the perforating gun.

The number of shaped charges is 6; 3 of the 6 charges positioned in a first plane transverse to the longitudinal axis of the perforating gun and the remaining 3 of the charges positioned in a second plane transverse to the longitudinal axis of the perforating gun.

The number of shaped charges is 8; 4 of the charges positioned in a first plane transverse to the longitudinal axis of the perforating gun and the remaining 4 of the charges positioned in a second plane transverse to the longitudinal axis of the perforating gun.

The shaped charges are arranged such that each of the shaped charges occupy a distinct plane; the distinct plane transverse to the longitudinal axis of the perforating gun.

The charges are selected from a group consisting of: reactive, and non-reactive charges.

The charges are selected from a group consisting of: deep penetrating charges, big hole charges, and equal entry hole charges.

A diameter of the openings ranges from 0.2 inches to 1.2 inches.

An external feature on the outside of the wall; the external feature aligned to the internal feature.

Exemplary embodiments of a perforating short gun for use in a horizontal well casing has been disclosed. The gun includes a gun carrier and a charge holder to carry shaped charges. The charge holder is inserted into the gun carrier and a selected length of the gun carrier includes internal features, such as scallops, created to a depth in an inside wall of the gun carrier. The internal features are located and configured to align with each of the shaped charges to create a standoff (or "distance") between a face of each of the shaped charges and a nearest internal feature such that the shaped charges create openings through the internal feature, when detonated.

While examples of embodiments of the technology have been presented and described in text and some examples also by way of illustration, it will be appreciated that various changes and modifications may be made in the described technology without departing from the scope of the inventions, which are set forth in and only limited by the scope of the appended patent claims, as properly interpreted and construed.

What is claimed is:

1. A perforating gun for use in a well casing, the gun comprising:

a gun carrier made of a single tubular element having an inner face with internal features therein extending into the inner face to a depth therein; and a charge holder configured to carry only three charges, wherein the three charges are located in a plane transverse to a longitudinal axis of the perforating gun, the charge holder configured to be inserted into the gun carrier, wherein each of the only three charges is housed independently in a corresponding casing, wherein when the charge holder loaded with charges is inserted into the gun carrier, each charge is adjacent to an internal feature of the inner face, and a standoff is created between the charge and the internal feature such that when detonated, each charge creates an opening through the internal feature, and wherein a length of the gun carrier is less than 14 inches.

2. The perforating gun of claim 1, wherein the length of the gun carrier ranges from 6 inches to 11 inches.

3. The perforating gun of claim 1, wherein a detonator cord passes through each of the shaped charges, the detonating cord passing longitudinally along a center of the charge holder.

4. The perforating gun of claim 1, wherein the standoff ranges from 0.15 to 2.5 inches.

5. The perforating gun of claim 1, wherein a diameter of the gun carrier ranges from 1 to 4 inches.

6. The perforating gun of claim 1, wherein the internal feature is an elongate shaped scallop, the elongate shaped scallop extending circumferentially within the inner face surface of the gun carrier such that the scallop has a constant thickness portion and a peripheral variable thickness portion in the inner face, the variable thickness portion surrounding the constant thickness portion.

7. The perforating gun of claim 1, wherein each of the three charges has a liner that has a subtended angle from 100° to 120°.

8. The perforating gun of claim 1, wherein the internal feature comprises a groove extending circumferentially, at least partially, in the inner face surface at locations adjacent charges to provide the standoff.

9. The perforating gun of claim 1, wherein a thickness of the gun carrier at the internal feature ranges from 50 to 75 thousandths of an inch.

10. The perforating gun of claim 1, wherein a diameter of the gun carrier ranges from 4 to 8 inches.

11. The perforating gun of claim 1, wherein the shaped charges are oriented in an upward direction.

12. The perforating gun of claim 1, wherein the charges are reactive liner shaped charges.

13. The perforating gun of claim 1, further comprising at least one external feature, the at least one external feature machined on an outside of the wall and configured and located to register with one of the internal features.

14. The perforating gun of claim 1, wherein the charge holder further comprises an end cap configured to connect to the gun carrier to position the charge holder relative to the gun carrier.

15. An ultra-short universal cluster gun used for perforation in a well casing, the gun comprising:

a gun carrier made of a single tubular element; and a charge holder configured to hold shaped charges in individual charge cases;

the charge holder configured to be inserted into the gun carrier;

the individual charge cases arranged in two planes or three planes, each of the planes transverse to the longitudinal axis of the gun, wherein each of the individual charge cases, of the two planes or two adjacent planes of the three planes, extends into a given cross-section plane of the single tubular element, and wherein at least one shaped charge of the shaped charges has a liner that has a subtended angle from 100° to 120°.

16. The universal cluster gun of claim 15, wherein a length of the gun carrier ranges from 4 inches to 11 inches.

17. The universal cluster gun of claim 15, wherein at least 3 shaped charges occupy the charge cases in one of the two planes and at least 3 shaped charges occupy the charge cases in the other of the two planes.

18. The universal cluster gun of claim 15, wherein at least 2 shaped charges occupy the charge cases in one of the two planes and at least 3 shaped charges occupy the charge cases in the other of the two planes.

19. The universal cluster gun of claim 15, wherein at least 2 shaped charges occupy the charge cases in one of the two planes plane and at least 4 shaped charges occupy the charge cases in the other of the two planes.

20. The universal cluster gun of claim 15, wherein an inner face of the gun carrier has internal features extending to a depth therein, such that when the charge holder loaded with charges is inserted into the gun carrier, each charge is adjacent to a corresponding internal feature of the inner face, and a standoff is created between the charge and the internal feature.

21. The perforating gun of claim 15, wherein the charge holder further comprises an end cap configured to connect to the gun carrier to position the charge holder relative to the gun carrier.

22. A perforating gun for use in a well casing, the gun comprising:

a gun carrier made of a single tubular element having an inner face with internal features therein extending into the inner face to a depth therein; and a charge holder configured to carry three charges located in a single plane transverse to a longitudinal axis of the perforating gun, the charge holder configured to be inserted into the gun carrier, wherein each of the three charges is housed independently in a corresponding casing, wherein when the charge holder loaded with the three charges is inserted into the gun carrier, each charge of the three charges is adjacent to a corresponding internal feature of the inner face, and a standoff is created between the charge and the corresponding internal feature such that when detonated, each charge creates an opening through the internal feature, wherein a length of the gun carrier ranges from 4 to 11 inches, and wherein at least one charge of the three charges has a liner that has a subtended angle from 100° to 120°.

23. The perforating gun of claim 22, wherein the charge holder further comprises an end cap configured to connect to the gun carrier to position the charge holder relative to the gun carrier.

* * * * *